US011998107B2

(12) United States Patent
Michael et al.

(10) Patent No.: US 11,998,107 B2
(45) **Date of Patent: *Jun. 4, 2024**

(54) QUICK DETACH BELT LOOP

(71) Applicant: Vista Outdoor Operations LLC, Anoka, MN (US)

(72) Inventors: Christopher J. Michael, Belgrade, MT (US); Daniel Sereday, Belgrade, MT (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/130,628

(22) Filed: Apr. 4, 2023

(65) Prior Publication Data

US 2023/0276929 A1 Sep. 7, 2023

Related U.S. Application Data

(63) Continuation of application No. 17/501,176, filed on Oct. 14, 2021, now Pat. No. 11,638,476, which is a continuation of application No. 16/715,865, filed on Dec. 16, 2019, now Pat. No. 11,147,360.

(60) Provisional application No. 62/780,159, filed on Dec. 14, 2018.

(51) Int. Cl.
*A45F 5/02* (2006.01)
*F41C 33/04* (2006.01)

(52) U.S. Cl.
CPC ..... *A45F 5/021* (2013.01); *F41C 33/041* (2013.01)

(58) Field of Classification Search
CPC ..... A45F 5/021; A45F 2200/0591; F41C 33/041; Y10S 16/13; Y10T 16/5257
USPC ..... 224/667, 671–672, 674–675
See application file for complete search history.

(56) References Cited

U.S. PATENT DOCUMENTS

| | | | | |
|---|---|---|---|---|
| 3,589,574 | A | 6/1971 | Marburger | |
| 4,193,164 | A | 3/1980 | Okayama | |
| 4,271,999 | A | 6/1981 | Stravitz | |
| 4,604,772 | A | 8/1986 | Arff | |
| 4,793,484 | A * | 12/1988 | Schoettle | E05D 7/081 206/387.1 |
| 6,145,169 | A | 11/2000 | Terzuola et al. | |
| 6,510,592 | B1 | 1/2003 | Hamilton | |
| 7,555,817 | B2 * | 7/2009 | Hsu | G06F 1/1681 16/367 |
| 7,657,977 | B2 | 2/2010 | Clifton, Jr. | |

(Continued)

*Primary Examiner* — Adam J Waggenspack
(74) *Attorney, Agent, or Firm* — Reed Smith LLP; Matthew P. Frederick; Cheryl L. Gastineau

(57) ABSTRACT

In embodiments, a belt clamp includes an inboard plate and an outboard plate that are pivotally coupled at their upper ends. The belt clamp may also include a spring biased locking mechanism that selectively and releasably connects the lower end of the inboard plate to the lower end of the outboard plate by way of locking posts in the inboard plate that are displaced upwardly from the lower edge of said plate. The outboard locking plate may have latch members that are entirely contained (except for opposing actuation buttons) within a compartment formed by two portions of the outboard plate connected by a living hinge. The opposing actuation buttons require a motion in a first direction, such as upwardly, to allow motion in a second direction, such as inwardly, to rotate the latching members inwardly to release the locking posts.

23 Claims, 7 Drawing Sheets

(56) References Cited

U.S. PATENT DOCUMENTS

| | | | | |
|---|---|---|---|---|
| 7,971,762 | B2 | 7/2011 | Clifton, Jr. | |
| 8,584,319 | B1 * | 11/2013 | Ludin | E05D 7/1061 16/262 |
| 9,027,212 | B2 * | 5/2015 | Wu | G03B 17/561 24/3.12 |
| 9,480,328 | B2 | 11/2016 | Stevens | |
| 9,726,457 | B2 * | 8/2017 | Parsons | A45F 5/021 |
| 10,684,094 | B2 | 6/2020 | Shinkle | |
| 2004/0204169 | A1 | 10/2004 | Goradesky | |
| 2006/0101627 | A1 | 5/2006 | Ida | |
| 2012/0124776 | A1 | 5/2012 | McDonnell | |

* cited by examiner

QUICK DETACH BELT LOOP

CROSS-REFERENCE TO RELATED APPLICATION

This application is a Continuation of U.S. patent application Ser. No. 17/501,176, filed Oct. 14, 2021, which is a Continuation of U.S. patent application Ser. No. 16/715,865, filed Dec. 16, 2019, now U.S. Pat. No. 11,147,360 which claims the benefit of U.S. Provisional Application No. 62/780,159, filed Dec. 14, 2018, the disclosure of which is incorporated by reference.

BACKGROUND OF THE DISCLOSURE

Belt-mounted tools and accessories have become an important part of the equipment used by military, police, militia, and civilian firearm users. Examples of popular belt-mounted tools and accessories include handguns, magazines, tasers, flashlights, handcuffs and telescoping batons. Specially designed holsters are used for supporting these tools and accessories. The holsters may be arranged on a utility belt. The interchangeability of tools and accessories is of particular importance to military and law enforcement personnel attached to special operations units, as this allows a utility belt to be reconfigured to meet certain mission specific needs.

SUMMARY

In embodiments, a belt clamp includes an inboard plate and an outboard plate that are pivotally coupled at their upper ends. The outboard plate having features for attachment of a holster or accessory. The inboard and outboard plates having a range of motion with favored positions provided by a detent in a hinge. The belt clamp also includes a spring biased locking mechanism that selectively and releasably connects the lower end of the inboard plate to the lower end of the outboard plate by way of locking posts in the inboard plate that are displaced upwardly from the lower edge of said plate. The outboard locking plate having latching members that are entirely contained (except for opposing actuation buttons) within a compartment formed by two portions of the outboard plate connected by a living hinge. The opposing actuation buttons require a motion in a first direction, such as upwardly, to allow motion in a second direction, such as inwardly, to rotate the latching members inwardly to release the locking posts. The belt may be clamped between the inboard plate and the outboard plate by placing the belt between plates and urging the lower ends of the plates together whereby the locking posts deflect the latching members momentarily opening the locking mechanism. An interior adjustment bar for sizing the belt clamp to varying belt sizes has two outer deflectable prongs and a stabilizing tongue intermediate the prongs. The prongs and tongue are inserted into a selected slot of a stack of slots in the inboard plate for adjustably fixing the bar in the appropriate adjustment place, the tongue precluding excessive and potentially destructive deflection of the deflectable prongs.

In embodiments, a belt clamp includes an inboard plate and an outboard plate that are pivotally coupled at their upper ends. The belt clamp also includes a spring biased locking mechanism that selectively and releasably connects the lower end of the inboard plate to the lower end of the outboard plate. A belt may be clamped between the inboard plate and the outboard plate by placing the belt between plates and pressing the lower ends of the plates together such that locking posts on one plate engage and deflect cooperating and rotatable latch members on the other plate to actuate, that is, momentarily open the locking mechanism.

In embodiments, a belt clamp comprises an inboard plate and an outboard plate connected to the inboard plate at an upper pivoting connection, each plate comprising an upper hinge portion, the upper hinge portions cooperating to form the upper pivoting connection at an upper end of the belt clamp. The hinge may comprise interlaced knuckles with unitary pins extending from select knuckles in one of the inboard plate and outboard plate for being received by inner voids in the other of the inboard plate and outboard plate. A feature and advantage of embodiments is that the use of unitary pin or pins precludes the need of the conventional separate hinge pin extending through the interlaced knuckles.

In embodiments, the locking mechanism includes a pair of latching portions configured as distinct latching members that are rotatably and slidably supported by the outboard plate so that the latching members can translate between an insertion position and a locked position. The latching members can engage with a complementary portion formed on the inboard plate while the latching members are urged inwardly be unlocking forces. Unlocking forces may be formed by ramp portions of the latching members and the complementary portions. In embodiments, unlocking forces are produced when the outboard plate is pressed against the latching members can be used to urge the latching members toward the insertion position. Unlocking forces may also be produced by the user's thumb and the user's index finger. In embodiments, the button portion can also be urged inward the insertion position by squeezing the latching members between the thumb and index finger of the user's hand. Each button portion includes a ribbed finger engaging portion for this purpose. The plates are pivotally connected to one another at a hinge pin that extends through a hinge portion of the inboard plate and a hinge portion of the outboard plate. The pin may be unitary with one or the other of the inboard plate and outboard plate.

A feature and benefit of embodiments is an interior plate including ramped ribs at the lower end thereof that lead to the locking posts. In embodiments, the ramped ribs allow for easier installation of the belt clamp onto a belt while the belt is being worn by a user, guiding the belt through juncture of the user's pants and the inwardly facing surface of the belt. In embodiments, the ramped ribs have geometry that reduces the likelihood that the belt clamp will snag or catch on the belt or surrounding clothing as compared to similar products.

A feature and benefit of embodiments is an interior plate including locking portions that blend into ramped ribs, giving increased rigidity and strength to the locking posts.

In embodiments, this arrangement reduces the likelihood that the locking posts will be damaged during use while during insertion of the clamp on a belt and during removal of the clamp from a belt.

A feature and benefit of embodiments is an upper pivoting connection between the inboard plate and the outboard plate extending along an upper end of the belt clamp. In embodiments, the upper pivoting connection comprises a hinge portion of each plate that cooperate to form a hinge, the hinge having a hinge width. In embodiments, a ratio of the hinge width to the overall width of the belt clamp is greater than 0.9. This arrangement provides stability, robustness and ease of assembly to the hinge portion. This arrangement also distributes applied forces across a greater area of the hinge portion. In embodiments, the hinge portions of the plates are coupled using a simple assembly process with no separate hinge pin. Hinge knuckles on one of the inboard plate and outboard plate may snap onto hinge pins unitary with the other of the inboard plate and outboard plate.

A feature and benefit of embodiments is an upper pivoting connection between the inboard plate and the outboard plate formed by snapping together a pair of cooperating hinge portions of the plates. In embodiments, each hinge portion includes a plurality of pin portions and a plurality of C-shaped pin receiving portions. In embodiments, each pin portion of the inboard plate mates with a C-shaped portion of the outboard plate. In embodiments, each C-shaped portion of the inboard plate mates with a pin portion of the outboard plate. A feature and advantage of embodiments is a pivoting arrangement having a pin portion that snaps into a corresponding C-shaped portion. This arrangement provides manufacturing advantages including fewer parts, easier assembly, the possibility of performing a repair by replacing a plate, and the possibility of replacing a plate with one or more plates having alternate configurations to suit the preferences of different users.

A feature and advantage of embodiments is a belt clamp made almost entirely of polymeric material, except for springs and fasteners. This arrangement provides ease of assembly and cost efficiencies by minimizing the number of parts and minimizing the number of assembly steps. In embodiments, the pivoting arrangement includes a plurality of polymer pin portions that are received in a corresponding C-shaped portions, the pin portions and the C-shaped portions being integrally formed along upper portions of the plates.

A feature and advantage of embodiments is that the locking mechanism is biased, such as by a spring, to a pre-actuation position and is automatically reset after the belt clamp is opened. The belt clamp can be locked onto a belt at a new position without manual reset of the locking mechanism.

A feature and advantage of embodiments is that the lock mechanism is actuated by the user's thumb and the user's index finger. A feature and advantage of embodiments is that finger receiving buttons of the retaining mechanism are positioned to allow for the most intuitive and ergonomic unlocking of the belt clamp from a belt. This allows the user to press his or her thumb and index finger against the buttons with less tension in the muscles and tendons of the index finger, thumb and forearm. The position of the buttons provide for natural and comfortable movement of the hand while the belt clamp is being worn on a belt and forearm is extending in a downward direction.

A feature and advantage of embodiments is a compartment for containing the movable latching members formed by an extending portion of the outboard plate connected to a lower edge of the outboard plate by a living hinge. The extending portion configured as a cover shaped to fit into a compartment defining containment portion of the outboard plate. Folding over the extending portion into the compartment to cover and close the compartment provides fewer separate parts and makes for a robust containment. Features, such as posts or recesses on the inside surfaces of the extending portion and the containment portion of the outboard plate can provide constraint of the latch members and control a movement path or rotation of the latch members.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 2:
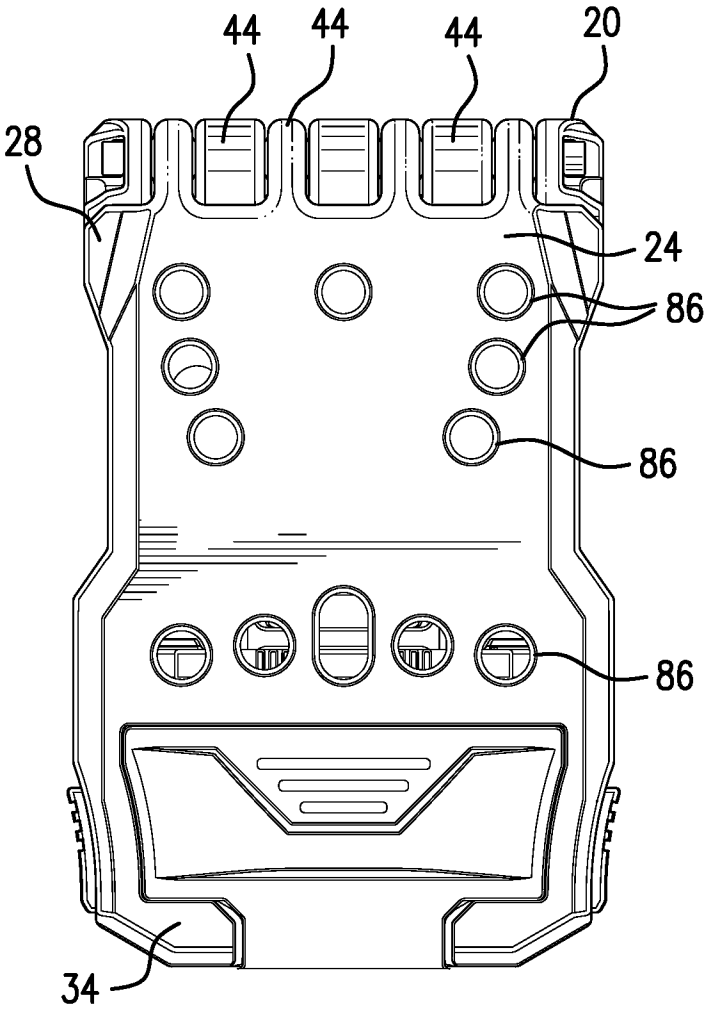
FIG. 2 is a perspective view showing the outboard plate side of an embodiment of a belt clamp.
Figure 1:
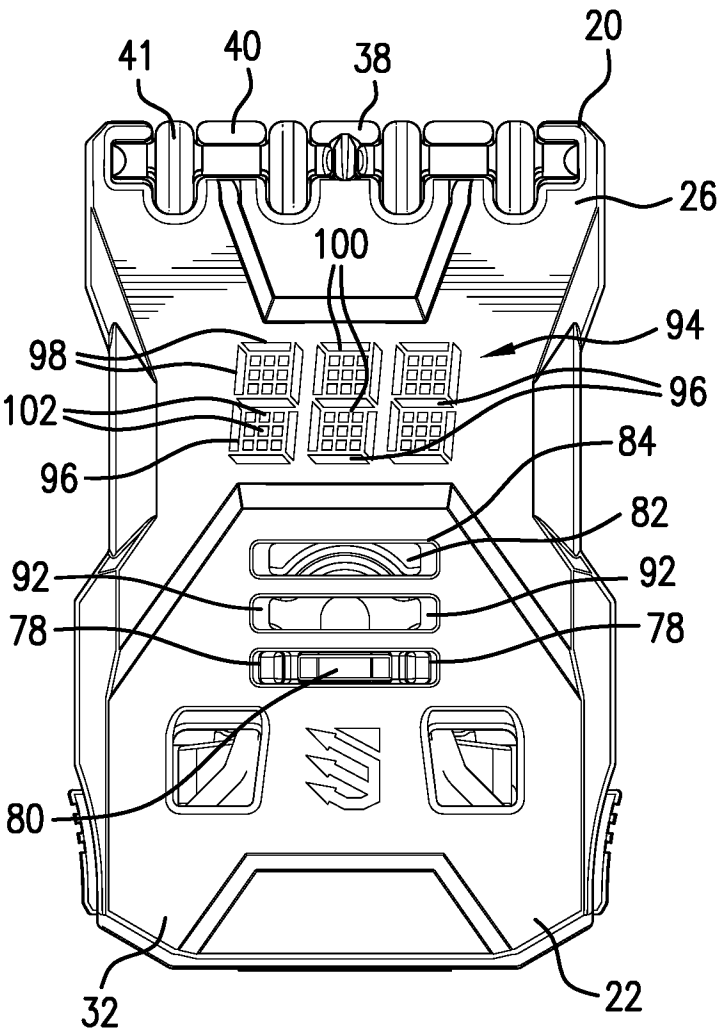
FIG. 1 is a perspective view showing the inboard plate side of an embodiment of a belt clamp.
Figure 3:
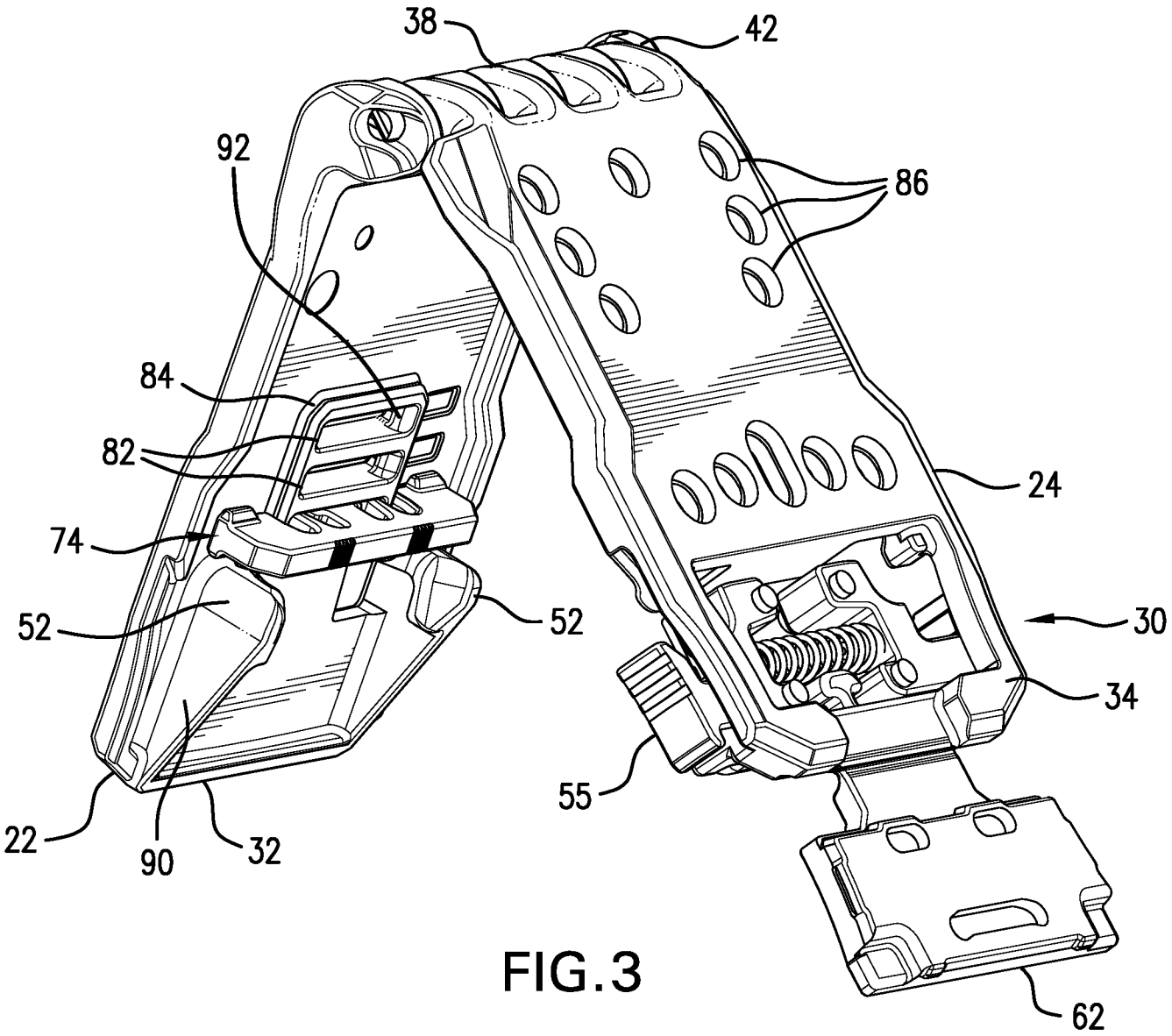
FIG. 3 is a perspective view showing an embodiment of a belt clamp opened and with the latch mechanism compartment open.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

It will be understood that relative terms, such as "lower" or "bottom" and "upper" or "top," may be used herein to describe one element's relationship to another elements as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure.

Referring to FIGS. 1-4 and 7, in embodiments, a belt clamp 20 includes an inboard plate 22 and an outboard plate 24 that are pivotally coupled at their upper ends 26, 28. The belt clamp 20 also includes a spring biased locking mechanism 30 that selectively and releasably connects the lower end 32 of the inboard plate 22 to the lower end 34 of the outboard plate 24. A belt 43 may be clamped between the inboard plate 22 and the outboard plate 24 by placing the belt 43 between inboard plate 22 and the outboard plate 24 and locking the lower ends 32, 34 of the plates 22, 24 together using the locking mechanism 30, See FIG. 7. Outboard plate 24 may have features such as holes 86 for attachment of a holster or accessory.

Figure 4:
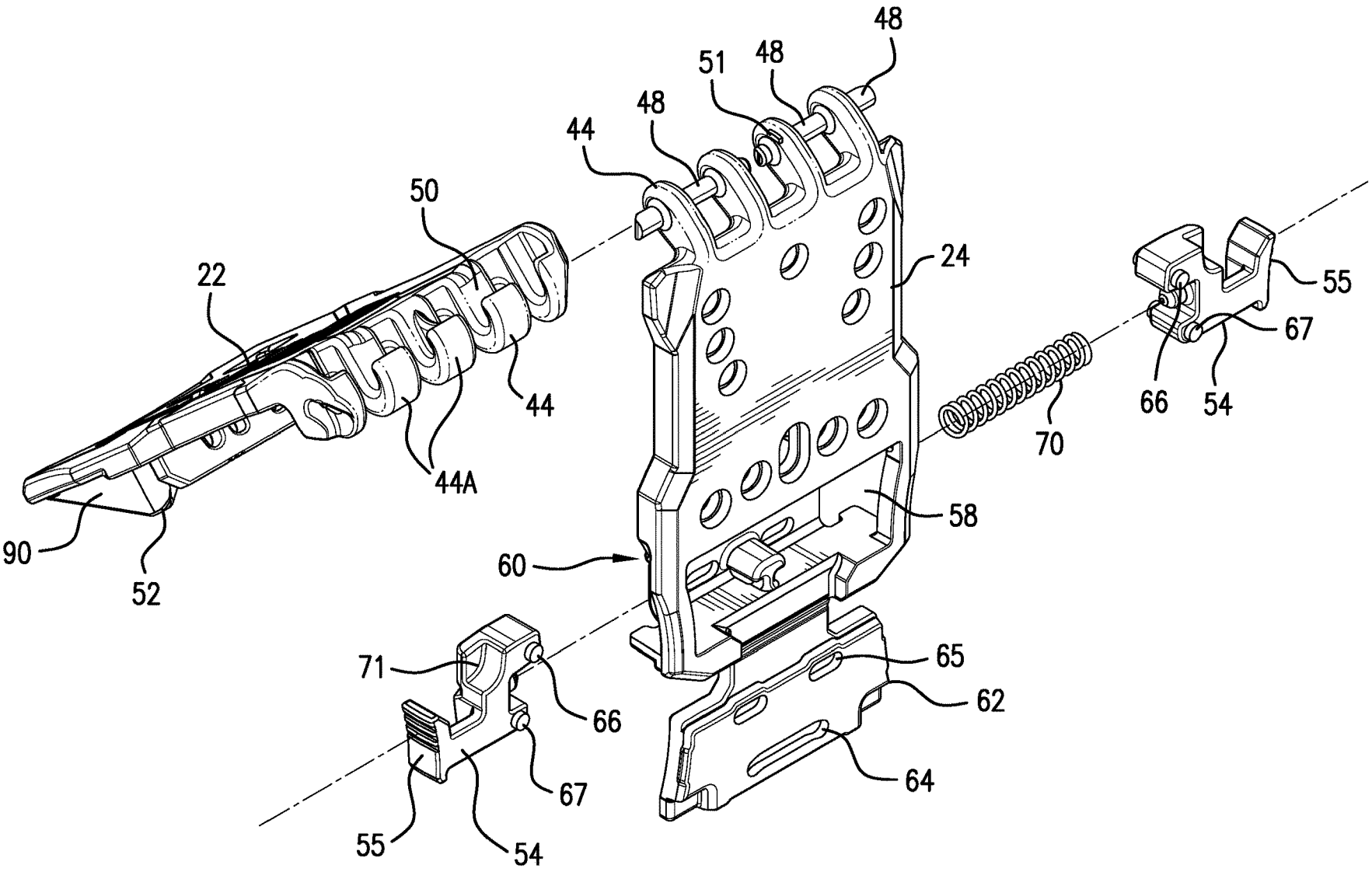
FIG. 4 is an exploded view showing a belt clamp.
Figure 5:
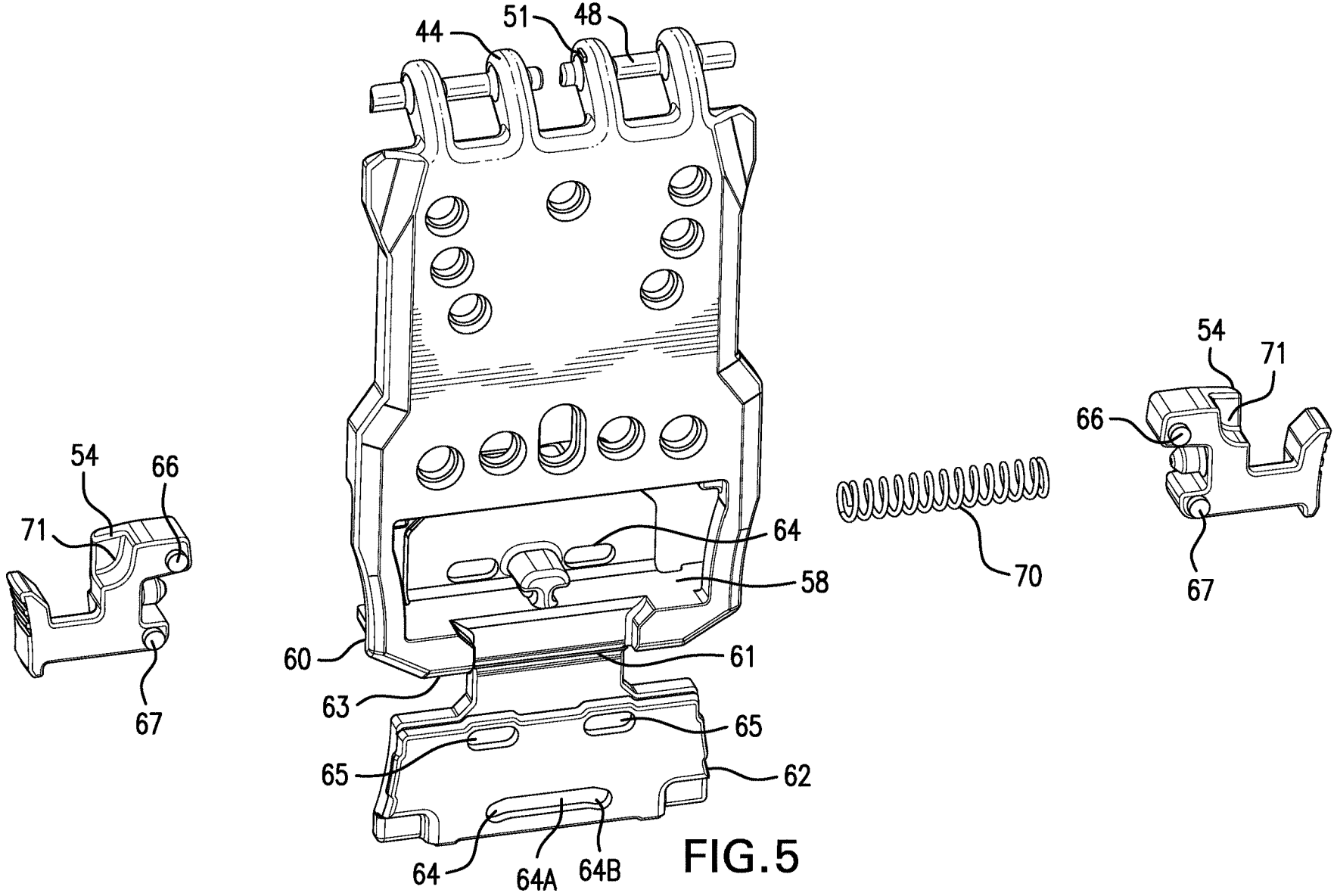
FIG. 5 is an exploded perspective view of the outboard plate components of a belt clamp.

In embodiments, the inboard plate 22 and an outboard plate 24 connected to the inboard plate 22 at an upper pivoting connection 38. Each plate 22, 24 comprising an upper hinge portion 40, 41; the upper hinge portions 40, 41 cooperating to form the upper pivoting connection 38 at an upper end 42 of the belt clamp 20. Each plate 22, 24 has interlaced knuckles 44. At least one of the inboard plate 22 and outboard plate 24 may have pins 48 that are unitary with the respective knuckles 44 of said plate to fit in the knuckle voids 50 of the knuckles 44 of the other plate 22, 24. As shown in FIG. 4, inboard plate 22 may have knuckles 44 having a C-shaped portion 44A. Outboard plate 24 may have pins 48 that extend between and are unitary with respective knuckles 44. Each C-shaped portion 46 of inboard plate 22 mates with a portion of a pin 48 of outboard plate 24 and may be snapped into place. In embodiments, a ratio of the upper hinge portion 40, 41 width to the overall width of the belt clamp 20 is greater than 0.9. A detent feature, configured as a nub 51 may provide favored positions in the range of motion of the inboard plate 22 and outboard plate 24. The nub 51 can interface with a cooperating feature (not shown) on an adjacent knuckle 44 or can simply disengage the adjacent knuckle 44 at certain positions in the range of rotation of the inboard and outboard plates 22, 24 of the clamp 20.

Referring to FIGS. 3-6C, in embodiments, the locking mechanism 30 includes locking posts 52 on the inboard plate 22 that are displaced upwardly from the lower end 32 of inboard plate 22. Locking posts 52 cooperate with latching portions configured as latching members 54 with finger buttons 55. Latching members 54 are rotatably and slidably supported by the outboard plate 24 in a compartment 58 defined by a containment portion 60 of the outboard plate 24. Latching members 54 are entirely contained within containment portion 60 with the exception of opposing finger buttons 55. A living hinge 61 connects an extension portion 62 to a lower margin 63 of the outboard plate 24. The extension portion 62 is configured as a compartment cover to fit into and close the compartment 58. Features, such as recesses 64, 65 in the outboard plate 24 and the extension portion 62, when the extension portion 62 or cover is closed, can constrain the latching members 54 by cooperating with features on the latching members 54 such as nubs 66, 67 to predefined motions/pathways. Recesses 64 may include a pair of upper recesses or a single elongated recess 64 each having an angled shape with a horizontal portion 64A on the innermost portion and an upwardly angled portion 64B on the outermost portion(s) of each recess 64. Recesses 65 may include a pair of horizontally extending lower recesses 65. A metal coil spring 70 can be positioned between the latching members 54 in the compartment 58 urging the latching member 54 to a latching or catch position with respect to the locking posts 52 wherein each latching member 54 has a catch portion 71 on an upper portion thereof which is configured to latch or catch with a respective locking post 52. Ends of metal coil spring 70 may be attached to attachment features such as knobs 88 disposed on opposed interior surfaces of latching members 58. Nubs 66, 67 may be disposed on the inside facing surface latching members 54 and may include an upper nub 66 disposed above knob 88 and a lower nub 67 disposed below knob 88. Upper nubs 66 are moveable within upper recesses 64, and lower nubs 66 are moveable within lower recesses 65.

Figure 6C:
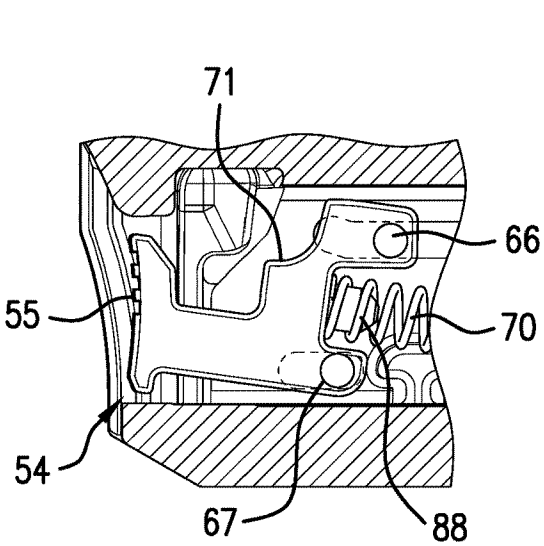
FIGS. 6A-6C is a series of images showing the motion of the latch members to release the latch mechanism.
Figure 6B:
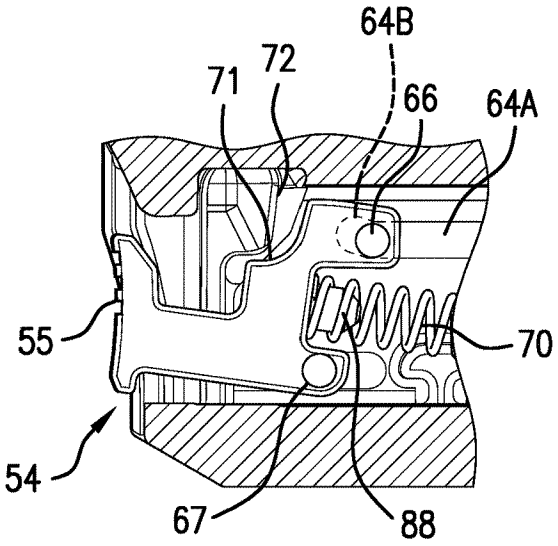
Figure 6A:
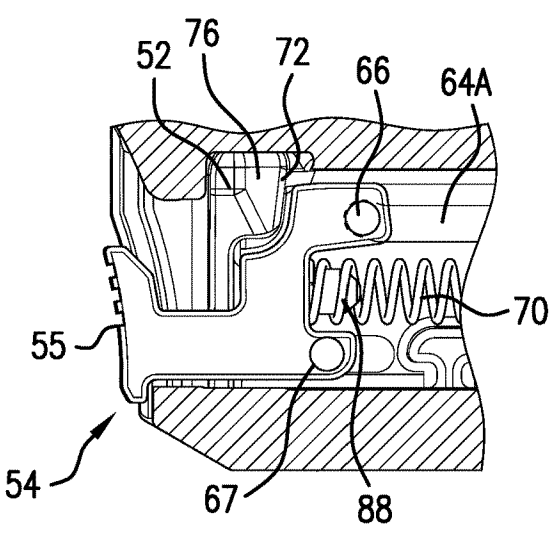
Figure 8:
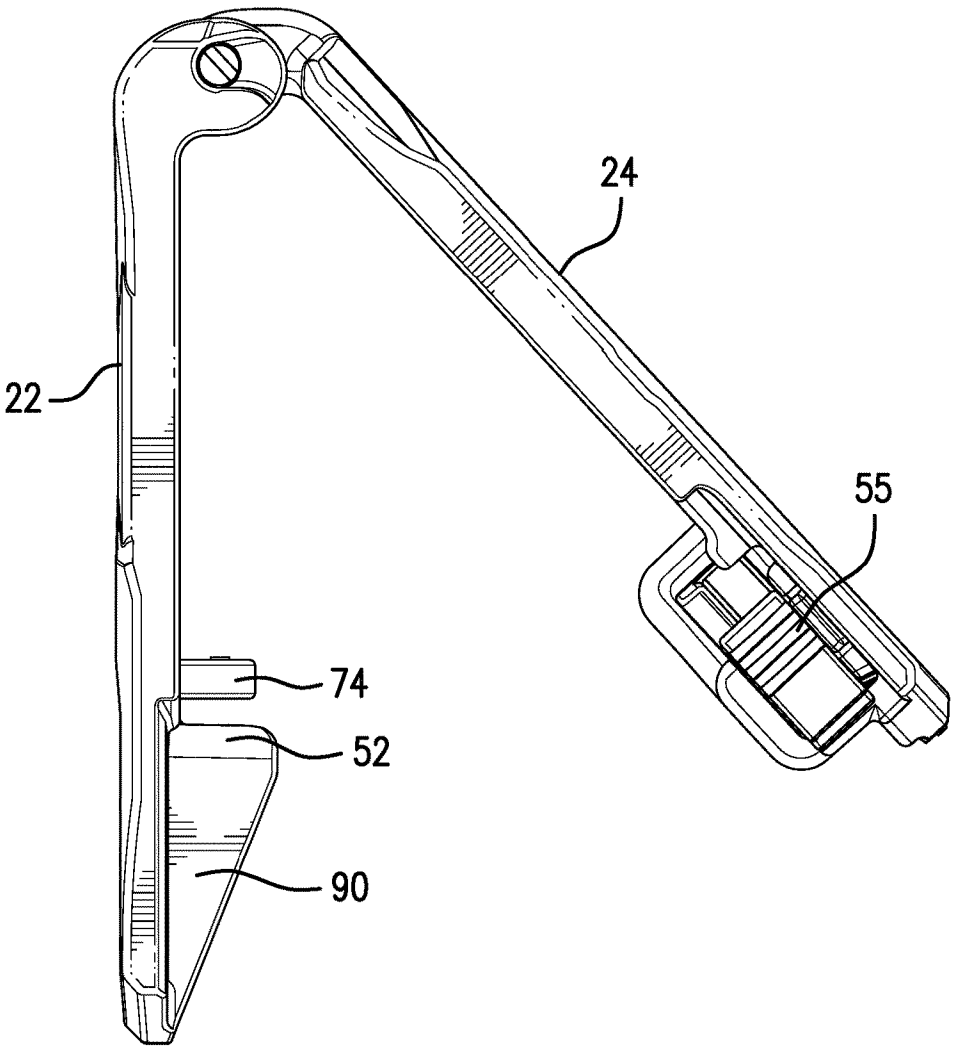
FIG. 8 is side elevational view of a belt clamp partially open.

Referring to FIGS. 6A-6C, the recesses 64, 65 and nubs 66, 67 may define a path for the latching members 54 that requires an upward initial motion of each finger button 55 so that upper nubs 66 move upwardly and inwardly within upwardly angled portions 64B of upper recesses 64 causing each latching member 54 to rotate about lower nub 67 (FIG. 6B) from an initial locked/pre-actuation position (FIG. 6A). Then an inward motion of each finger button 55 moves nubs 66 and 67 horizontally inwardly along horizontal portion 64A of recess 64 and recess 65, respectively, so that catch portions 71 move to a non-obstructing/release/insertion position, see FIG. 6C, with respect to engagement portions 72 of the locking posts 52. Locking mechanism 30 is biased by spring 70 to pre-actuation position (FIG. 6A) and is automatically reset after belt clamp 20 is opened. Belt clamp may be locked onto a belt 43 at a new position without manual reset of locking mechanism 30. Unlocking forces may be produced by the user's thumb and the user's index finger. In embodiments, the finger buttons 55 may be urged inward to the insertion position (FIG. 6C) by squeezing the finger buttons 55 between the thumb and index finger of the user's hand. Each finger buttons 55 includes a ribbed finger engaging portion for this purpose.

Locking posts 52 also have ramp portions 76 that when the two plates 22, 24 are pushed together deflect the latching members 54 inwardly moving them to a non-obstructing positon allowing the engagement portion 72 of the locking posts 52 to push past the catch portions 71 whereby the latching members 54 snap back to the latch positon, see FIG. 6A.

Referring to FIGS. 3, 4, 8, 9 and 10, some embodiments may include ramped ribs 90 at the lower end 32 of inboard plate 22 that lead to the locking posts 52. In embodiments, ramped ribs 90 allow for easier installation of belt clamp 20 onto a belt 43 while the belt 43 is being worn by a user, guiding the belt 43 through juncture of the user's pants and the inwardly facing surface of the belt 43. In embodiments, ramped ribs 90 have a ramped configuration that reduces the likelihood that belt clamp 20 will snag or catch on the belt 43 or surrounding clothing as compared to similar products.

Figure 7:
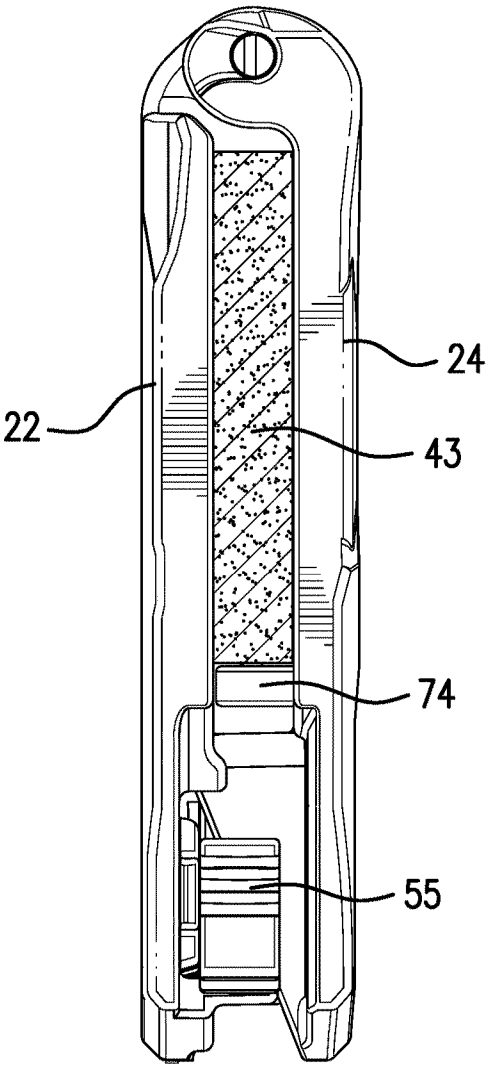
FIG. 7 is a side elevational view of a closed belt clamp.
Figure 10:
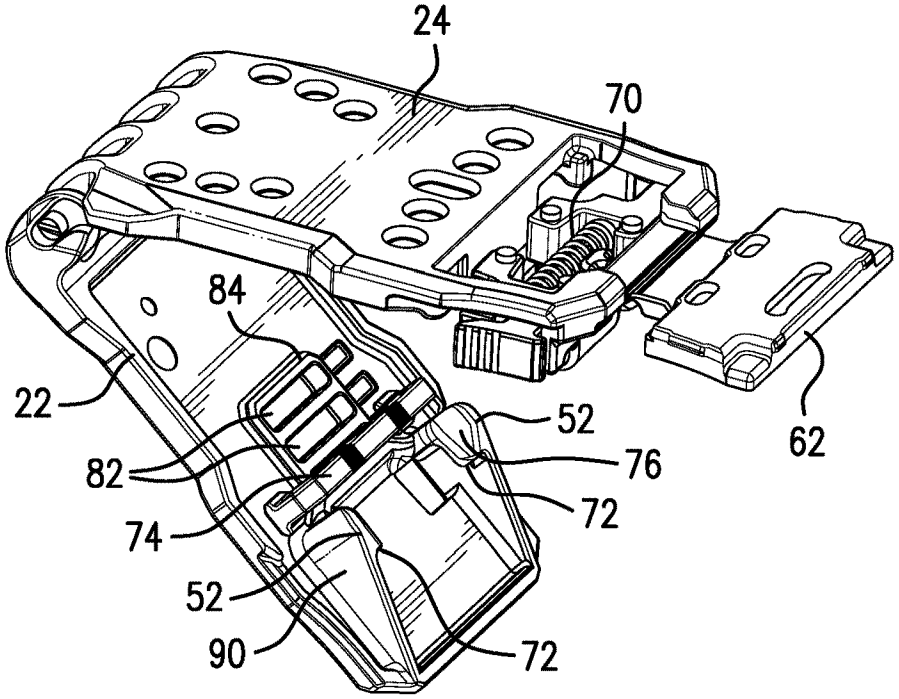
FIG. 10 is another perspective view of a belt clamp partially open with the mechanism compartment open.
Figure 9:
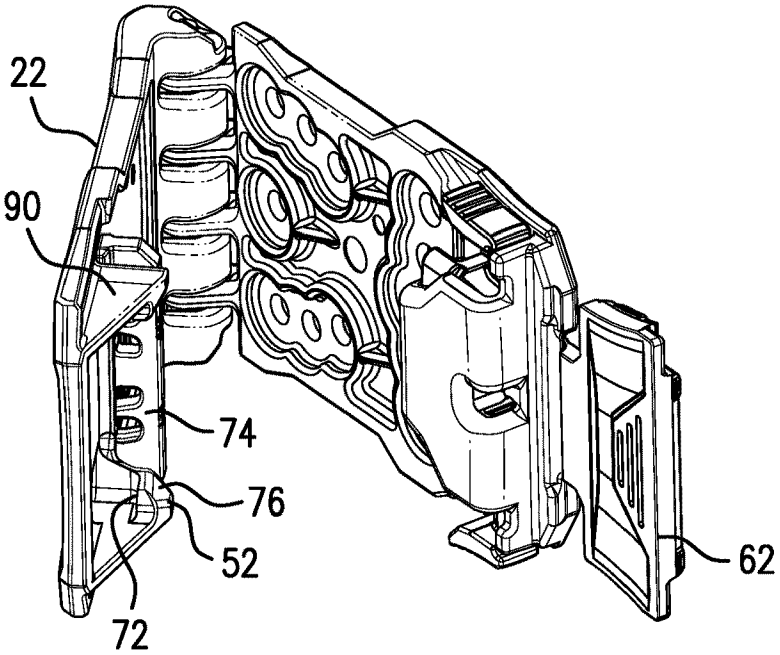
FIG. 9 is a perspective view of a belt clamp partially open and with the extension portion.

Referring to FIGS. 1, 3, 4 and 7-10, some embodiments may have an interior adjustment bar 74 for sizing belt clamp 20 to varying belt sizes. Adjustment bar 74 is configured as a sizing bar for spanning at least partially across the inside of one of the inboard plate 22 and outboard plate 24. As shown in FIG. 7, adjustment bar 74 is positioned below the lower edge of belt 43 such that belt 43 is disposed between adjustment bar 74 and knuckles 44. Adjustment bar 74 may have two outer deflectable prongs 78 and a stabilizing tongue 80 intermediate the prongs 78. The prongs 78 and tongue 80 are inserted into a selected slot 82 of a stack 84 of slots in inboard plate 22 for adjustably fixing adjustment bar 74 in the appropriate adjustment place. In this manner, the belt clamp can accommodate belts of varying widths. A pair of web portions 92 may be positioned at ends of each slot 82, each of the pair of web portions 92 displaced from an outer surface of the respective plate 22, 24. For example, adjustment bar 43 may be positioned in lower slots 82 of stack 84 for larger width belts 43, for example, 2 inch and 2.25 inch. Tongue 80 precludes excessive and potentially destructive deflection of the deflectable prongs 78.

Embodiments of belt clamp 20 may be made almost entirely of polymeric material, except for spring 70.

Embodiments of belt clamp 20 may further include at least one marking display 94 disposed on at least one of the inboard plate 22 or the outboard plate 24. Marking display 94 is configured to receive markings from a marker, pen, paint pen or paint applicator. This allows the user to mark or individualize belt clamp 20 as they see fit (e.g. add their initials or identification numbers, and correlate to the product variables). In the exemplary embodiment shown in FIG. 1, marking display 94 is disposed on the inboard side of inboard plate 22. Marking display 94 includes at least one marking matrix 96 formed from recessed, or concave surfaces, in one embodiment, lines 98 arranged in a seven-segment display configuration. In this embodiment, recessed or concave lines 98 form a rectangular figure eight with three horizontal lines and four vertical lines forming two vertically stacked rectangles 100. A plurality of recessed or concave dots or squares 102 may be disposed in each rectangle 100, arranged in a matrix including a plurality of rows of dots or squares and a plurality of columns of dots or squares. By way of example, each marking display 94 may include three marking matrices 96 having nine recessed or concave dots or squares 102. By nature of being recessed or concave, the marking surfaces retain the paint or ink inside the marking surface, without being wiped, scuffed, or abraded away by rubbing against other objects. Marking matrix 96 may be useful on a variety of equipment in addition to the embodiments herein, including holsters, firearms, gear bags, helmets, vests, etc. The following United States patents are hereby incorporated by reference herein: U.S. Pat. Nos. 6,145,169, 7,657,977, 7,971,762, 8,517,234, 9,027,212, 9,451,821, 9,476,670, 9,480,328, and 9,726,457. Published U.S. Patent Applications US2006/0196903 and US2017/0205172 are hereby incorporated by reference herein for all purposes. All U.S. patents issuing from and claiming priority to U.S. patent application Ser. No. 15/261,079 are hereby incorporated by reference herein.

The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A belt clamp for securing a holster or accessories to a user's belt, the belt clamp comprising:

a first plate and a second plate that are pivotally coupled at respective first ends at respective hinge portions;

one or more spring biased first locking mechanisms configured to selectively and releasably connect a second end of the first plate to a second end of the second plate, wherein the one or more spring biased first locking mechanism comprises one or more latching members positionable between a latched position and an unlatched position, wherein the one or more latching members comprise two finger buttons facing in opposite directions to one another, the one or more latching members configured to be biased to the latched position; and one of the second end of the first plate and the second end of the second plate comprising one or more second locking mechanisms configured to engage with the one or more latching members.

2. The belt clamp of claim 1, wherein the second plate further comprises a lower mechanism compartment defined by a containment portion of the second plate, and an extension portion connected by a living hinge to a lower margin of the second plate, the extension portion conformingly sized to the lower mechanism compartment, wherein the extension portion is configured to be foldable over into the compartment for closing the compartment with the one or more latching members in the compartment, and wherein the containment portion and the extension portion have molded features therein configured for constraining movement of the one or more latching members between the latched position and the unlatched position, and wherein the one or more latching members are configured to be rotatably and slidably moved between the latched position and the unlatched position.

3. The belt clamp of claim 2, wherein the one or more latching members comprise a pair of latching members, and further comprising a coil spring urging each of the pair of latching members to the latching position, and wherein the compartment is configured to substantially contain the pair of latch members and the coil spring when the compartment is closed by the extension portion.

4. The belt clamp of claim 1, wherein the first plate comprises an inboard plate and the second plate comprises an outboard plate.

5. The belt clamp of claim 1, wherein the one or more second locking mechanisms are displaced from a lower margin of the inboard plate and comprise a respective ramp at a distal end of each respective one or more second locking mechanisms.

6. The belt clamp of claim 1, wherein each of the respective hinge portions comprises a plurality of knuckles, wherein the plurality of knuckles of one of the first plate and the second plate comprises a unitary hinge pin, and wherein the unitary hinge pin is received in the knuckles of the other of the first plate and second plate.

7. The belt clamp of claim 1, further comprising at least one marking display disposed on at least one of the first plate and second plate, wherein the marking display comprises at least one marking matrix comprising recessed lines arranged in a seven-segment display configuration.

8. A belt clamp for securing a holster or accessories to a user's belt, the belt clamp comprising:

a first plate and a second plate that are pivotally coupled at respective first ends at respective hinge portions;

one or more spring biased first locking mechanisms configured to selectively and releasably connect a second end of the first plate to a second end of the second plate, one or more locking features on one of the second end of the first plate and the second end of the second plate, the one or more spring biased first locking mechanisms further comprising at least one latching member on the other of the second end of the first plate and the second end of the second plate, the at least one latching members configured to latchingly engage the one or more locking features;

wherein the at least one latching members comprise at least two finger buttons facing in opposite direction to one another, and the at least two finger buttons are configured to be slidably spring biased away from one another to a latched position.

9. The belt clamp of claim 8, wherein each of the respective hinge portions comprises a plurality of knuckles, wherein the plurality of knuckles of one of the first plate and the second plate comprises a unitary hinge pin, wherein the unitary hinge pin is received in the knuckles of the other of the first plate and second plate, and wherein at least one of the knuckles has a detent portion that provides a favored and an unfavored region in a range of motion of the first plate and second plate, wherein the detent portion comprises a nub extending in a direction parallel to a hinge axis of the respective hinge portions.

10. The belt clamp of claim of claim 8, wherein the second plate comprises a lower mechanism compartment defined by a containment portion of the second plate, wherein the second plate comprises an extension portion connected by a living hinge to a lower margin of the second plate, the extension portion conformingly sized to the compartment, and wherein the extension portion is configured to be foldable over into the compartment for closing the compartment with the one or more latching members in the compartment.

11. The belt clamp of claim 10, wherein the containment portion and the extension portion comprise molded features therein configured for constraining movement of the one or more latching members between the latched position and the unlatched position, and wherein the one or more latching members are configured to be rotatably and slidably moved between the latched position and the unlatched position.

12. The belt clamp of claim 8, wherein the locking features comprise one or two locking posts unitary with the first plate and projecting in an outboard direction; and wherein the one or two locking posts are displaced from a lower margin of the first plate and wherein each of the one or two locking posts comprises a respective ramp at a distal end of each respective locking posts.

13. The belt clamp of claim 8, further comprising at least one marking display disposed on at least one of the first plate and the second plate, wherein the marking display comprises at least one marking matrix comprising recessed lines arranged in a seven-segment display configuration.

14. A belt clamp for securing a holster or accessories to a user's belt, the belt clamp comprising:

a first plate and a second plate each comprising a respective hinge portion at a respective first end, the first plate and the second plate pivotally coupled at respective first ends at the respective hinge portions;

a locking mechanism that selectively and releasably connects a second end of the first plate to a second end of the second plate, wherein one of the second end of the first plate and the second end of the second plate comprises at least one ramped rib, wherein the at least one ramped rib incorporates a portion of the locking mechanism and is configured to guide the user's belt during installation of the belt clamp onto the belt.

15. The belt clamp of claim 14, further comprising a belt width adjustment bar, wherein one of the first plate and second plate comprise a plurality of openings for receiving the belt width adjustment bar;

wherein the belt width adjustment bar comprises a sizing bar configured for spanning at least partially across the inside of the one of the first plate and second plate; and wherein the belt width adjustment bar further comprises a pair of prongs spaced apart to be received in each of the plurality of openings by deflecting inwardly, and a central tongue member positioned between the pair of prongs, the tongue member limiting inward deflection of each of the pair of prongs, wherein the openings are slots disposed on the first plate; and wherein each slot comprises a pair of web portions at ends of the slot, each of the pair of web portion displaced from an outer surface of the respective plate.

16. The belt clamp of claim of claim 14, wherein the second plate comprises a lower mechanism compartment defined by a containment portion of the second plate, wherein the second plate comprises an extension portion connected by a living hinge to a lower margin of the second plate, the extension portion conformingly sized to the compartment, and wherein the extension portion is configured to be foldable over into the compartment for closing the compartment with one or more latching members in the compartment.

17. The belt clamp of claim 16, wherein the containment portion and the extension portion comprise molded feature therein configured for constraining movement of the one or more latching members between the latched position and the unlatched position, and wherein the one or more latching members are configured to be rotatably and slidably moved between the latched position and the unlatched position.

18. The belt clamp of claim 14, wherein the first plate comprises one or two locking posts unitary with the first plate and projecting in an outboard direction; and wherein the one or two locking posts are displaced from a lower margin of the first plate and wherein each of the one or two locking posts has a respective ramp at a distal end of each respective locking posts.

19. The belt clamp of claim 14, wherein each of the respective hinge portions comprises a plurality of knuckles, wherein the plurality of knuckles of one of the first plate and the second plate has a unitary hinge pin, and wherein the unitary hinge pin is received in the knuckles of the other of the first plate and second plate.

20. The belt clamp of claim 14, further comprising at least one marking display disposed on at least one of the first plate and the second plate, wherein the marking display comprises at least one marking matrix comprising recessed lines arranged in a seven-segment display configuration.

21. The belt clamp of claim 1, wherein the second plate comprises a lower mechanism compartment defined by a containment portion of the second plate, wherein the second plate comprises an extension portion connected by a living hinge to a lower margin of the second plate, the extension portion conformingly sized to the compartment, and wherein the extension portion is configured to be foldable over into the compartment for closing the compartment with the one or more latching members in the compartment.

22. The belt clamp of claim 8, wherein the first plate comprises an inboard plate and the second plate comprises an outboard plate.

23. The belt clamp of claim 14, wherein the first plate comprises an inboard plate and the second plate comprises an outboard plate.

* * * * *